US005878463A

United States Patent [19]

Klüting et al.

[11] Patent Number: 5,878,463

[45] Date of Patent: Mar. 9, 1999

[54] DOOR LOCK FOR A MOTOR VEHICLE DOOR FORMED INTEGRALLY WITH A DOOR HINGE

[75] Inventors: Bernd-Alfred Klüting, Radevormwald; Friedrich G. Klingelhöfer, Remscheid, both of Germany

[73] Assignee: ED. Scharwächter GmbH & Co. KG, Remscheid, Germany

[21] Appl. No.: 915,365

[22] Filed: Aug. 20, 1997

[30] Foreign Application Priority Data

Aug. 20, 1996 [DE] Germany ..... 196 33 451.9

[51] Int. Cl.[6] ..... E05D 11/10

[52] U.S. Cl. ..... 16/334; 16/330; 16/322

[58] Field of Search ..... 16/334, 330, 328, 16/329, 331, 332, 352, 353, 312–314, 299, 300, 321, 322

[56] References Cited

U.S. PATENT DOCUMENTS

| | | | |
|---|---|---|---|
| 1,078,002 | 11/1913 | Schrey | 16/334 |
| 1,159,525 | 11/1915 | Parizek | 16/334 |
| 4,829,633 | 5/1989 | Kassner | 16/322 |
| 5,173,993 | 12/1992 | Baker | 16/329 |
| 5,408,726 | 4/1995 | Kent | 16/326 |

*Primary Examiner*—Chuck Y. Mah

*Attorney, Agent, or Firm*—Anderson, Kill & Olick, P.C.

[57] ABSTRACT

A door lock for a motor vehicle door formed integrally with a door hinge and including a locking element having a plurality of detent points, with the locking element being formed as a substantially circular track concentric with respect to the hinge pin axis and securable to one of the two hinge halves without possibility of rotation relative to the one to hinge halves, a plurality of brake and locking members arrangeable concentrically with respect to the hinge pin radially outwardly of the hinge pin and operationally connectable with the hinge pin, and a spring-biased carrier for receiving the brake and locking members and arrangeable approximately congruently with the locking element.

7 Claims, 2 Drawing Sheets

DOOR LOCK FOR A MOTOR VEHICLE DOOR FORMED INTEGRALLY WITH A DOOR HINGE

BACKGROUND OF THE INVENTION

1. Field of the Invention

The present invention related to a door lock formed integrally with a door hinge having two hinge halves attachable, respectively, to the motor vehicle door and a respective motor vehicle door pillar, and a hinge pin for connecting the first and second hinge halves and supported in one of the two hinge halves with a running fit and removably secured in another of the two hinge halves without a possibility of rotation with respect to the another of the hinge halves, with the door lock including a locking element having at least one detente point and at least one brake and locking member cooperating with the locking element, with the locking element being formed as a circular track concentric with respect to the hinge pin axis and secured to the one of the first and second hinge halves for joint rotation therewith, and with the brake and locking member being operationally connected with the hinge pin and arranged radially outwardly of the hinge pin.

2. Description of the Prior Art

In a door lock which is formed integrally with a door hinge and in which the locking element is connected for joint rotation with a hinge half, in which the hinge pin is supported with a running fit, and is formed as a circular track concentric with the hinge pin axis and having indentations defining the detent points, the brake and locking members are formed as rolling bodies and are supported on axles which extend transverse to the hinge pin axis. The brake and locking members cooperate, when biased against the locking element by a loading spring supported against a collar or similar means provided at the free end of the hinge pin, with the detent points provided on the track. Such a door lock permits to advantageously reduce the dimensions of the door hinge-door lock assembly which results in less space required for such an assembly. Additional advantages of such a door lock consists in that the door lock construction permits to reduce substantially the manufacturing costs and insures a noiseless operation of the assembly. The drawbacks of such door hinge-door lock assembly consist in that the loading spring is formed by a stack of spring washers and acts on a middle region of the carrier of the brake and locking members, which surrounds the hinge pin. As a result, with unfavorable tolerance pairings, retaining the door in the predetermined opening positions of the door is not always possible, and/or the braking and retaining force applied to the door in a predetermined position is not always adequate.

Accordingly, an object of the invention is to so improve the door lock for a motor vehicle door, which is formed integrally with a demountable door hinge, that it insures an exact locking of the door in a predetermined braking and locking position of the door and a most possible noiseless operation of the door lock, independent of possible tolerance deviations.

SUMMARY OF THE INVENTION

This and other objects of the present invention, which will become apparent hereinafter, are achieved by providing a spring-biased carrier for receiving the brake and locking members, which is arranged concentrically with respect to the hinge pin and is arranged approximately congruently with the locking element. With such a carrier, the direct operational connection of the brake and locking members with the hinge pin results not only in reduced dimensions of the door hinge-door lock assembly but also permits to use another type of a biasing spring, which insurers an absolute exact retaining of the predetermined braking and locking positions of the door even when certain inevitable deviations of manufacturing tolerances of the components of the door hinge-door lock assembly exist.

In a preferred embodiment of the invention, the carrier has a pot shape and has a plurality of axially extending grooves, which are formed in an end surface of the cylindrical wall of the carrier remote from the locking element, with the grooves cooperating with corresponding portions of a driver plate which is connected with the hinge pin for joint rotation therewith, for form-lockingly connecting the carrier with the driver plate.

A reliable displacement of both the carrier and the braking and locking members is advantageously insured by providing the carrier with a centrally arranged guide member which facilitate axial displacement of the carrier along a portion of the hinge pin extending above the hinge half in which the hinge pin is supported with a running fit.

For securing the brake and locking members in the pot-shaped carrier, the carrier is provided with extensions which project from its bottom in the regions of the cylindrical wall and the guide member, with the brake and locking members, which are formed as conical rollers, being received in spaces defined by the extensions. At that, the conical rollers are rotatably supported on axle stubs, which extend transverse to the hinge pin axis and which are arranged in openings formed by the extensions of the cylindrical wall and the guide member. To facilitate the mounting of the brake and locking members, the respective extensions of the cylindrical wall and the guide member, which form the axle stub receiving opening, can be provided at free ends with slots through which the axle stubs can be pushed into the respective opening from below.

The loading of the brake and locking member can be effected with a spring which is supported at its opposite ends against the bottom of the carrier and the driver plate.

The track is defined by a collar provided on an end surface of a locking disc, which forms the locking element and which is secured to the first hinge half by a plurality of the cylindrical pins. The track is inclined toward the circumference of the locking disc and is provided with a plurality of indentations which define detent points. Advantageously, the plurality of the detent points exceeds the number of brake and locking members, and the indentations, which define the detente points, are arranged in pairs opposite each other.

According to the present invention, the carrier can support two brake and locking members cooperating with the circular tract. However, preferably, there are provided four brake and locking members which are arranged in the carrier in pairs of oppositely located brake and locking members.

Independent of the shape of the carrier and the number of the brake and locking members, the driver plate, which connects the carrier with the hinge pin, has an axial opening, a cross-section of which deviates from a pure circular cross-section and which cooperates with a corresponding cross-section of an associated portion of the hinge pin for connecting the driver plate with the hinge pin for joint rotation therewith.

According to the present invention, there is provided a protective bonnet for protecting the door lock. The protective bonnet is secured at the circumference of the locking disc which forms the locking element.

BRIEF DESCRIPTION OF THE DRAWINGS

The features and objects of the present invention will become more apparent, and the invention itself will be best understood from the following detailed description of the preferred embodiments when read with reference to the accompanying drawings, wherein.

DETAILED DESCRIPTION OF THE PREFERRED EMBODIMENT

Figure 1:
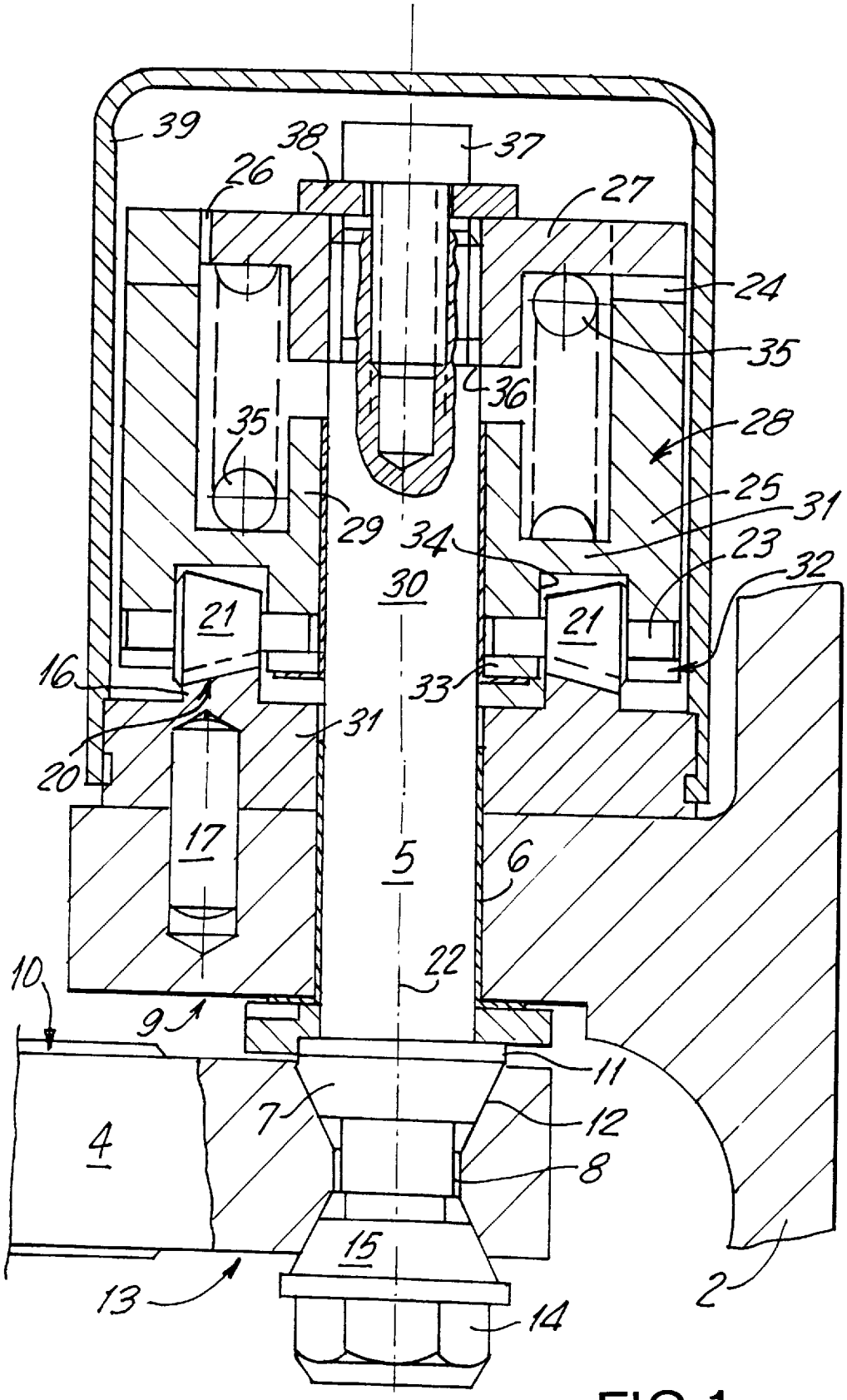
FIG. 1 shows a longitudinal cross-sectional view of a separable motor vehicle door hinge according to the present invention and formed integrally with a door lock.
Figure 2:
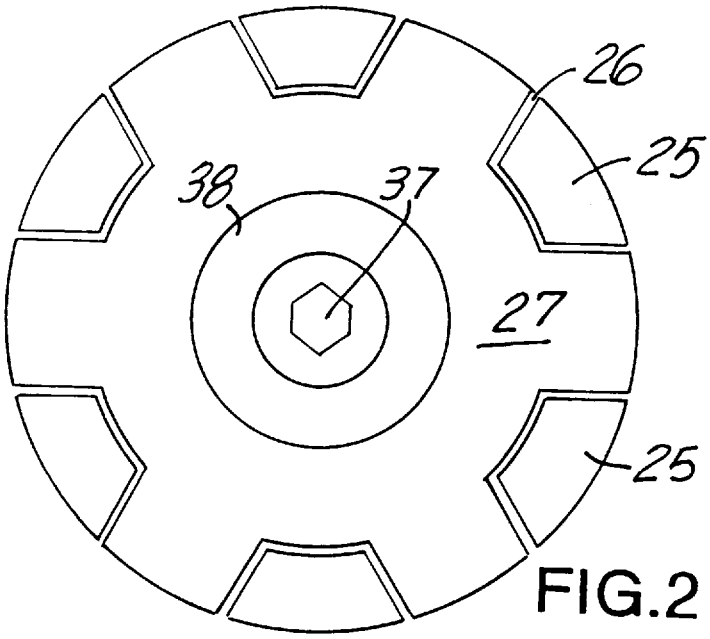
FIG. 2 shows a cross-sectional view of the door lock, which is shown in FIG. 1, along line II—II in FIG. 1.
Figure 3:
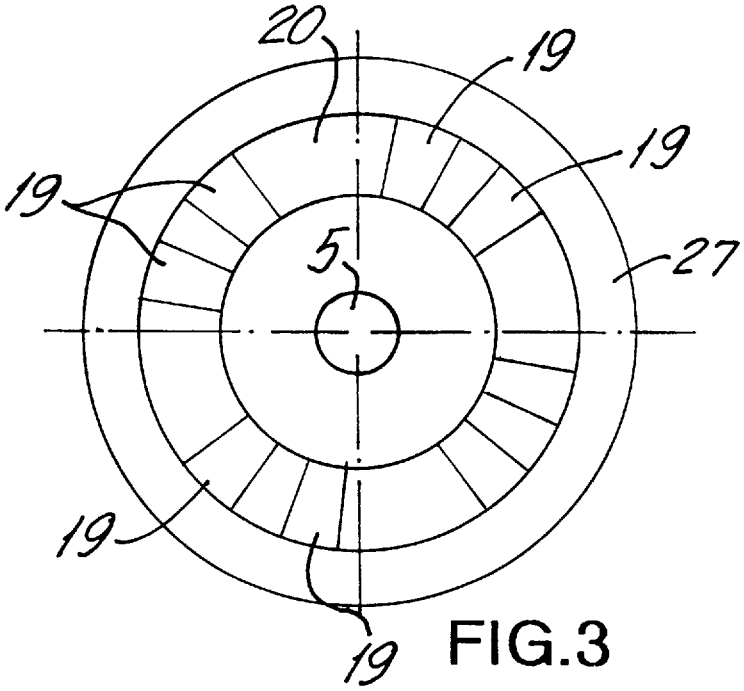
FIG. 3 shows a schematic view showing locations of detent points of the door lock shown in FIG. 1.

A separable door hinge according to the present invention, which is shown in the drawings, is formed of a first hinge half 2 attachable to one of two components of a door assembly (not shown in the drawings), a second hinge half 4 attachable to another of the two components of the door assembly, and a hinge pin 5 which pivotally connects the hinge halves 2 and 4 with each other. The hinge pin 5 is supported in the hinge half 2 by a bearing sleeve 6 formed of a maintenance-free bearing material. The hinge pin 5 is supported in the bearing sleeve 6 with a running fit which insures a free rotation of the hinge pin 5, but it is retained from axial displacement in the hinge half 2. In a mounting position of the door hinge, the hinge pin 5 is secured in the gudgeon 8 of the hinge half 4 against rotation relative to the hinge half 4 with radially extending form-lockingly operating means 7. The hinge pin 5 has a radially extending collar 11 which engages adjacent surfaces 9 and 10 of the hinge halves 2 and 4. The collar 11 has, at a side-thereof adjacent to the hinge half 2, a cone 12 tapering toward the end of the hinge pin 5. The cone 12 forms the radially extending form-lockingly operating means 7. The gudgeon bore of the hinge half 4 has a conical surface which forms complementary form-lockingly operating means associated with the form-lockingly operating means 7. The hinge pin 5 is secured against automatic lifting from the gudgeon bore of the hinge half 4 by a nut 14, which engages the outer surface 13 of the gudgeon 8 of the hinge half 4 and cooperates with a thread provided at the free end of the hinge pin 5. The nut 14 has a conical extension 15 which extends into a conical widening of the hinge pin 4 provided opposite the conical surface of the gudgeon bore of the hinge half 4 which forms complementary form-lockingly operating means.

The door lock, which is formed integrally with the door hinge, includes a locking element, a plurality of brake and locking members, a carrier for the brake and locking members, which is connected with the hinge pin 5, and a spring for biasing the brake and locking members into their locking position. In the embodiment shown in the drawings, the locking element is formed by a track 20 formed on a locking disc 18, which is secured to the first hinge half 2 for joint pivotal movement therewith by a plurality of cylindrical pins 17. The track 20 is defined by a collar 16, provided on the end surface of the locking disc 18 remote from the hinge half 2. The track 20 is arranged concentrically with respect to the axis 2 of the hinge pin 5 and is provided with a plurality of detent points 19. As shown in FIG. 1, the track 20 is inclined toward the circumference of the locking disc 18. The detent points 19 are defined by indentations formed in the track 20. The detent points 19 are arranged, with respect to the hinge pin 5, in pairs opposite each other.

The brake and locking members 21, which cooperable with the track 20, are formed as conical rollers with an inclination corresponding to that of the track 20. The brake and locking members are arranged in the carrier 28 and are rotatably supported by axles 23 which extend transverse to the hinge pin axis 22.

The carrier 28 of the brake and locking members 21 is formed as a pot-shaped member and has a plurality of axially extending grooves 24, which are formed in the end surface of its usually closed cylindrical wall 25. The grooves 24 provide for form-locking connection of the carrier 28 with a driver plate 27, which is fixedly connected with the hinge pin 5 for joint rotation therewith and has, along its circumference, a plurality of radially extending recesses 26 having in the plan view a trapezoidal-like shape. The depth of the axially extending grooves 24 exceeds the thickness of the driver plate 27 by at least the height of the detent points 19 of the track 20. The carrier 28 has a central guide member 29, with which the carrier 28 slides along a section 30 of the hinge pin 5 when being axially displaced with respect to the hinge pin 2. The guide member 29 is connected with the cylindrical wall 25 of the carrier 28 by a transverse bottom 31.

The carrier 28 has an extension 32, which projects downward from its bottom 31 in the region of the carrier cylindrical wall 25, and has an extension 33, which likewise projects downward from its bottom 31 in the region of the carrier guide member 29. The brake and locking members 21 are located partially in the space between the extensions 32 and 33, and partially between the cylindrical wall 25 and the guide member 29. The extensions 32 and 33 and portions of the cylindrical wall 25 and the guide member 29, which extend beyond the bottom 31, form together cavities 34 for receiving the brake and locking members 21. Free end surfaces of the extension 32 and 33 are provided with slots so that the axle stubs 23, which support the brake and locking members 21 can be pushed into the cavities 34 from beneath. Inside of the pot-shaped carrier 25, there is provided a loading spring 35. The loading spring 35 is supported, at its opposite ends, against the driverplate 27 and against the bottom 31 of the carrier 28. In the embodiment shown in the drawings, the loading spring 35 is formed as a helical spring and is arranged concentrically with the hinge pin 5.

In the embodiment shown in the drawings, there are provided four brake and locking members 21, which are symmetrically arranged in the carrier 28, i.e., they are arranged in pairs opposite each other. The driver plate 27 is supported, in the axial direction against a collar 36 of the hinge pin 5, on one hand, and against a retaining disc 38, which is connected with the hinge pin 5 by a bolt 37, on the other hand. The driver plate 27 has a through bore provided with internal toothing, which cooperates with a correspondingly shaped profile of the upper portion of the hinge pin 5, whereby the driver plate 27 is circumferentially connected with the hinge pins for joint rotation therewith. The locking device is protected against dust and/or dirt, on one hand, and against paint or lacquer abrasions, on the other hand, by a protective bonnet 39 which is secured to the circumference of the locking disc 18.

Though the present invention was shown and described with reference to the preferred embodiments, various modifications thereof will be apparent to those skilled in the art and, therefore, it is not intended that the invention be limited to the disclosed embodiments or details thereof, and departure can be made therefrom within the spirit and scope of the appended claims.

What is claimed is:

1. A door lock for a motor vehicle door and fixedly connectable with a demountable door hinge having first and second hinge halves attachable, respectively, to the motor vehicle door and a respective motor vehicle door pillar, and a hinge pin for connecting the first and second hinge halves with a running fit and removably secured in another of the first and second halves without a possibility of rotation with respect to the another of the first and second halves, the door lock comprising:

a looking element having a plurality of detent points, the locking element being formed as a substantially circular track concentric with respect to a hinge pin axis and securable to the one of the first and second hinge halves without a possibility of rotation relative to the one of the first and second to hinge halves;

a plurality of brake and locking members arrangeable concentrically with respect to the hinge in radially outwardly of the hinge pin and operationally connectable therewith, the brake and locking members cooperating with the locking element for locking the motor vehicle door in predetermined opening positions of the door determined by the detent points;

a spring-biased carrier for receiving the brake and locking members and arrangeable approximately congruently with the locking element;

a driver plate connectable with the hinge pin for joint rotation therewith;

wherein the carrier has a pot shape and has a plurality of axially extending grooves formed in an end surface of a circumferential wall thereof remote from the locking element and which cooperate with corresponding portions of the driver plate, which are defined by respective grooves provided in the driver plate, for form-lockingly connecting the carrier with the driver plate.

2. A door lock as set forth in claim 1, further comprising a loading spring for biasing the carrier toward the locking element and supported at opposite ends thereof against the bottom of the carrier and the driver plate.

3. A door lock as set forth in claim 1, wherein the driver plate has an axial opening, a cross section of which deviates from a pure circular cross-section and which cooperates with a corresponding cross-section of an associated portion of the hinge pin for connecting the driver plate with the hinge pin for joint rotation therewith.

4. A door lock for a motor vehicle door and fixedly connectable with a demountable door hinge having first and second hinge halves attachable, respectively, to the motor vehicle door and a respective motor vehicle door pillar, and a hinge pin for connecting the first and second hinge halves and supported in one of the first and second hinge halves with a running fit and removably secured in another of the first and second halves without a possibility of rotation with respect to the another of the first and second halves, the door lock comprising:

a locking element having a plurality of detent points, the locking element being formed as a substantially circular track concentric with respect to a hinge pin axis and securable to the one of the first and second hinge halves without possibility of rotation relative to the one of the first and secured to hinge halves;

a plurality of brake and locking members arrangeable concentrically with respect to the hinge pin radially outwardly of the hinge pin and operationally connectable therewith, the brake and locking members cooperating with the locking element for locking the motor vehicle door in predetermined opening positions of the door determined by the detent points; and a spring-biased carrier for receiving the brake and locking members and arrangeable approximately congruently with the locking element;

wherein the carrier has a centrally arranged guide member which provides for axial displacement of the carrier along a portion of the hinge pin projecting above the one of the first and second hinge halves; and wherein the carrier has extensions projecting from a bottom thereof in regions of the cylindrical wall and guide member, the brake and locking members, which are formed as conical rollers, being received in spaces defined by the extensions.

5. A door lock set as set forth in claim 4, further comprising a plurality of a axle stubs extendable transverse to an axis of the hinge pin and arranged in opening formed by the extensions of the cylindrical wall and the guide member for supporting the brake and locking members.

6. A door lock for a motor vehicle door and fixedly connectable with a demountable door hinge having first and second hinge halves attachable, respectively, to the motor vehicle door and a respective motor vehicle door pillar, and a hinge pin for connecting the first and second hinge halves and supported in one of the first and second hinge halves with a running fit and removably secured in another of the first and second halves without a possibility of rotation with respect to the another of the first and second halves, the door lock comprising:

a locking element having a plurality of detent points, the locking element being formed as a substantially circular track concentric with respect to a hinge pin axis and securable to the one of the first and second hinge halves without a possibility of rotation relative to the one of the first and second to hinge halves;

a plurality of brake and locking members arrangeable concentrically with respect to the hinge pin radially outwardly of the hinge pin and operationally connectable therewith, the brake and locking members cooperating with the locking element for locking the motor vehicle door in predetermined opening positions of the door determined by the detent points;

a spring-biased carrier for receiving the brake and locking members and arrangeable approximately congruently with the locking element; and cylindrical pin means for connecting the locking element with the one of the first and second halves in abutting relationship with the one of the first and second halves, the locking element being formed as a locking disc, and the track being inclined toward a circumference of the locking disc, with the detent points being defined by indentations formed in the track.

7. A door lock as set forth in claim 6, wherein the plurality of the detent points exceeds the plurality of the brake and locking members, and wherein the indentation defining the detent points are arranged in pairs opposite each other.

* * * * *